US011851858B2

(12) United States Patent
Wu et al.

(10) Patent No.: US 11,851,858 B2
(45) Date of Patent: Dec. 26, 2023

(54) PULL-OUT HEAD INTEGRATED WATERWAY STRUCTURE

(71) Applicant: RUNNER(XIAMEN) CORP., Fujian (CN)

(72) Inventors: Xiaofeng Wu, Fujian (CN); Yukang Zhang, Fujian (CN)

(73) Assignee: RUNNER(XIAMEN) CORP.

( * ) Notice: Subject to any disclaimer, the term of this patent is extended or adjusted under 35 U.S.C. 154(b) by 282 days.

(21) Appl. No.: 17/489,794

(22) Filed: Sep. 30, 2021

(65) Prior Publication Data

US 2022/0268002 A1 Aug. 25, 2022

(30) Foreign Application Priority Data

Feb. 19, 2021 (CN) ..... 202110189357.9

(51) Int. Cl.
*E03C 1/04* (2006.01)
*E03C 1/02* (2006.01)

(52) U.S. Cl.
CPC ..... *E03C 1/0405* (2013.01); *E03C 2001/026* (2013.01); *E03C 2001/0415* (2013.01)

(58) Field of Classification Search
CPC ..... E03C 1/0405; E03C 2001/026; E03C 2001/0415
USPC ..... 4/678, 675
See application file for complete search history.

(56) References Cited

U.S. PATENT DOCUMENTS 11,565,275 B2 * 1/2023 Xu ..... B05B 1/1636
2016/0024764 A1 * 1/2016 Lei ..... E03C 1/0405 137/601.19
2016/0136659 A1 * 5/2016 Erickson ..... B05B 1/18 239/443
2017/0342692 A1 * 11/2017 Hu ..... B05B 15/65
2018/0318849 A1 * 11/2018 Cao ..... E03C 1/04
2020/0376504 A1 * 12/2020 Yan ..... B05B 1/169
2021/0170427 A1 * 6/2021 Ye ..... B05B 1/16
2022/0186476 A1 * 6/2022 Zhang ..... E03C 1/0404
2022/0219189 A1 * 7/2022 Dai ..... E03C 1/06
2022/0243436 A1 * 8/2022 Wu ..... E03C 1/0404
2022/0364341 A1 * 11/2022 Zhang ..... E03C 1/08
2023/0050351 A1 * 2/2023 Lin ..... A61H 33/005

FOREIGN PATENT DOCUMENTS

EP 4053349 A1 * 9/2022 ..... E03C 1/0404

* cited by examiner

*Primary Examiner* — Lori L Baker
(74) *Attorney, Agent, or Firm* — Jose Cherson Weissbrot

(57) ABSTRACT

The pull-out head integrated waterway structure, including an integrated waterway body, the waterway body is provided with a second valve cavity and a first valve cavity through the waterway body, the first valve cavity is connected to the water inlet end of the waterway body through a first cavity, the first valve cavity and second valve cavity are connected through a second cavity, the second valve cavity is connected to the water outlet end of the waterway body through the outlet cavity, a first control spigot is provided in the first valve cavity for controlling the size of water flow, a second control spigot is provided in the second valve cavity for switching water flow to a different outlet cavity. The waterway body adopts integrated injection molding, avoiding the connection of different parts, improving the strength performance of the waterway, improving the strength of the product.

10 Claims, 7 Drawing Sheets

PULL-OUT HEAD INTEGRATED WATERWAY STRUCTURE

CROSS-REFERENCE TO RELATED APPLICATIONS

This application is based upon and claims priority to Chinese Application No. CN 202110189357.9, filed on Feb. 19, 2021, the entire contents of which are incorporated herein by reference.

FIELD OF THE INVENTION

The present invention relates to a pull-out head integrated waterway structure.

BACKGROUND OF THE INVENTION

For pull-out faucets, flow control has gradually become one of the mainstream functions, and most of the pull-out faucets have been formed by a combination of splash switching and flow control functions. For this type of structure, two switching mechanisms are required, and the waterway between the two switching mechanisms currently exists with a waterway welding mechanism and a waterway splitting mechanism solution. For the existing structure of the pull-out faucet, there are problems with the welding method, such as poor strength at the weld, spillage, more limited choice of materials, as well as the strength and sealing of the two sections of the waterway at the waterway connection, product cost, the large size of the mechanism, etc.

BRIEF SUMMARY OF THE INVENTION

In order to solve the above technical problems, the purpose of the present invention is to provide a pull-out head integrated waterway structure.

4. The structure is reliable and stable, and the size can be adjusted according to the appearance requirements, suitable for more kinds of appearance requirements.

BRIEF DESCRIPTION OF THE SEVERAL VIEWS OF THE DRAWINGS

In order to more clearly illustrate the technical solution of the present invention, the following is a brief description of the accompanying drawings required for use in the description of the embodiments or prior art. It will be apparent that the accompanying drawings in the following description are only some embodiments of the present invention, and that other accompanying drawings may be obtained on the basis of these drawings without creative labor by a person of ordinary skill in the art.

DETAILED DESCRIPTION OF THE INVENTION

Figure 1:
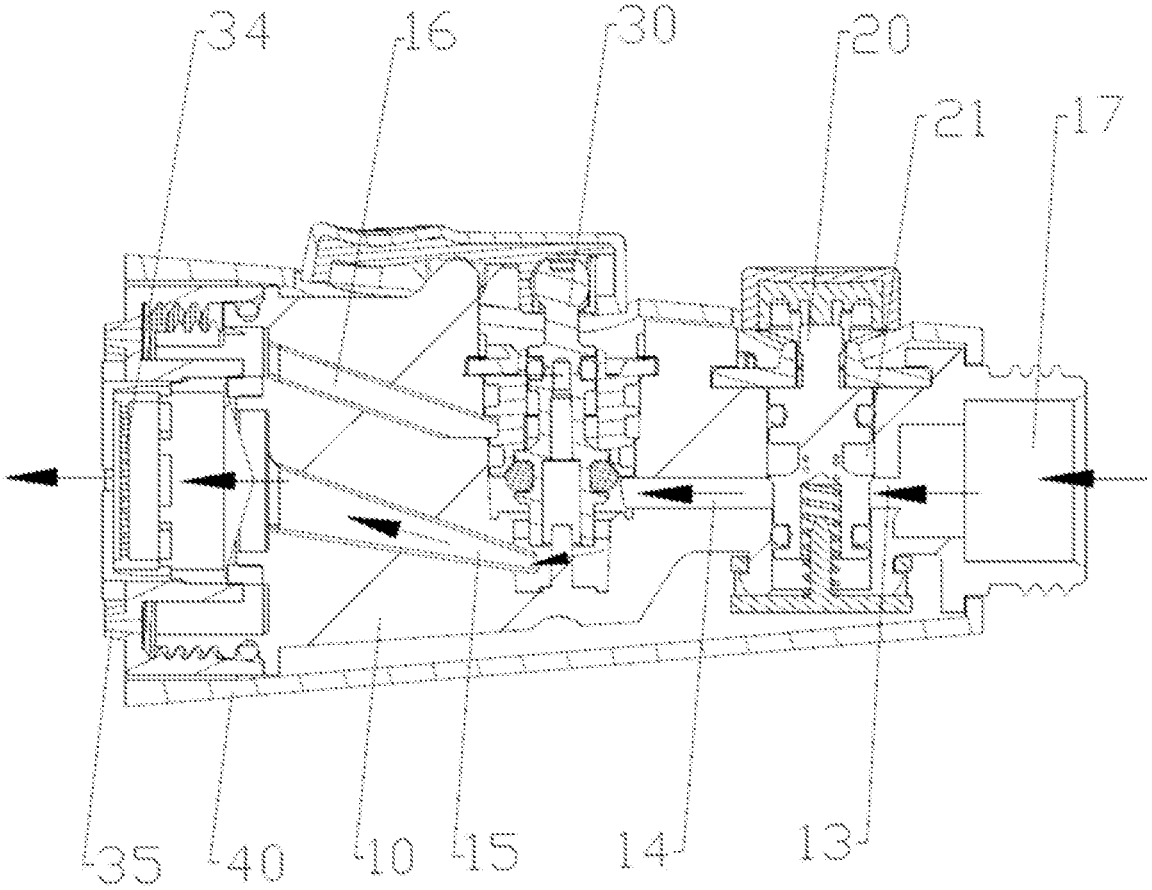
FIG. 1 is a cross-sectional view of state one of embodiment one of the present invention.
Figure 2:
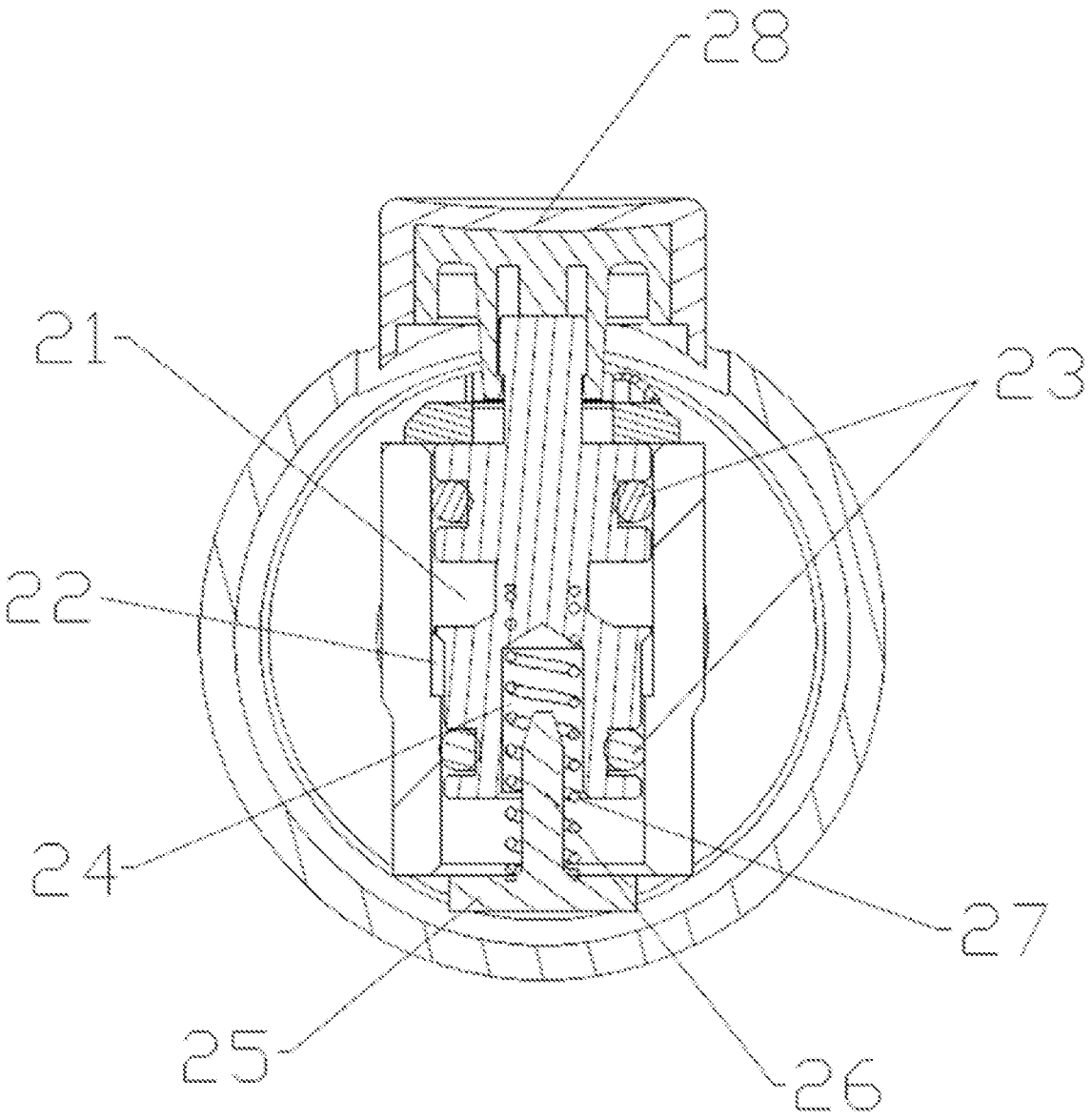
FIG. 2 is a cross-sectional view of the first control spigot of the present invention.

The technical solutions in the embodiments of the present invention will be clearly and completely described below in conjunction with the accompanying drawings in the embodiments of the present invention. Obviously, the described embodiments are only a part of the embodiments of the present invention, and not all of them. Based on the embodiments in the present invention, all other embodiments obtained by ordinary technicians in the art without making creative work belong to the protection scope of the invention.

By "an embodiment" or "embodiment" herein is meant a particular feature, structure or characteristic that may be included in at least one embodiment of the present invention. In the description of the invention, it is to be understood that the terms "top", "bottom", "top", "bottom", etc. are based on the orientation or positional relationship shown in the accompanying drawings and are intended only to facilitate and simplify the description of the invention, not to indicate or imply that the device or element referred to must have a particular orientation, be constructed and operate in a particular orientation, and therefore are not to be construed as limiting the invention. In addition, the terms "first" and "second" are used for descriptive purposes only and are not to be understood as indicating or implying relative importance or implicitly specifying the number of technical features indicated. Thus, the features qualified with "first" and "second" may explicitly or implicitly include one or more of these features. Moreover, the term "first", "second", etc. is used to distinguish similar objects and need not be used to describe a particular order or sequence. It should be understood that the data so used may be interchanged, where appropriate, so that embodiments of the invention described herein can be implemented in an order other than those illustrated or described herein.

Referring to the accompanying drawings of the specification, the present invention provides a pull-out head integrated waterway structure comprising an integrated waterway body 10 which is provided with a second valve cavity 12 and a first valve cavity 11 through the waterway body, the first valve cavity is connected to the water inlet end 17 of the waterway body through a first cavity 13, the first valve cavity and the second valve cavity are coupled through a second cavity 14, the second valve cavity is connected to the water outlet end 18 of the waterway body through the outlet cavity, the first valve cavity is provided with a first control spigot 20 for controlling the size of the water flow, and the second valve cavity is provided with a second control spigot 30 for switching the water flow to a different outlet cavity. The waterway body of the present invention adopts integrated injection molding, and each valve cavity and cavity can be completed through the core extraction structure on the mold, avoiding the connection of different parts and improving the strength performance of the waterway. It also reduces the number of parts of the product and reduces the difficulty of assembly. The outer shell 40 of the pull-out head structure can also be customized according to the appearance needs, and the size of the waterway body can be adjusted according to the appearance requirements, which is suitable for more kinds of appearance requirements.

In one embodiment, the first control spigot has a notch part 21 for large water flow in the central outer ring, and a gap 22 for small water flow between the outer wall of the first control spigot and the inner wall of the waterway body. When the first control spigot is in the jacked-up position, the water flow entering from the first cavity is blocked by the first control spigot in most of the pathway, and the water flow passes through the gap of the first control spigot, and only a small portion of the water flow reaches the second cavity, so the first control spigot is in a throttled state. The upper and lower ends of the notch part are provided with a first seal 23. The seal is provided to improve the sealing of the connection between the first control spigot and the waterway body, so that the water entering the first control spigot can only fully flow to the second cavity and will not leak out from the connection between the first control spigot and the waterway body.

Specifically, one end of the first valve cavity is provided with a first button 28 that fits the first control spigot, and the other end of the first valve cavity is provided with a base 25 that fits the first control spigot, and the base is connected to the waterway body, and the lower end of the first control spigot is provided with a first sink 24, and the base is provided with a convex pillar 26 that fits the first sink, and a resilient member 27 is connected between the first sink and the convex pillar. The first control spigot can be moved up and down in the first valve cavity by pressing the first button, which is simple and convenient to operate. The base is connected to the waterway body at one end of the first valve cavity, and the connection method can include threaded connection, snap connection, secondary injection molding and other connection methods; in this embodiment, a snap connection is used, and a snap hook is provided at the opening of one end of the first valve cavity, and there is a matching snap part on the base.

Further, the outlet cavity is provided with two, a third cavity 15 and a fourth cavity 16 coupled between the second valve cavity and the water outlet end. The outer ring of the second control spigot is provided with a second sealing member 31 that fits into the third cavity and the fourth cavity; when the second control spigot moves up, the second seal can block the fourth cavity, and water can only flow from the second control spigot into the third cavity; when the second control spigot moves down, the second seal also moves down to block the third cavity, so that the water can only flow from the second control spigot into the fourth cavity.

Further, the upper end of the second control spigot is provided with a second button 32 for controlling the up and down movement of the second control spigot, and the second button is coupled with a bump 19 on the waterway body. The lever principle is formed between the second button and the bump, and the upper end of the second control spigot is connected to the end of the second button, so that the second control spigot can be moved up and down by pressing the second button back and forth. In order to limit the upward and downward movement of the second control spigot in the second valve cavity, a guide sleeve 33 is provided in the second valve cavity, and the second control spigot is provided in the guide sleeve. There is a gap between the guide sleeve and the second valve cavity, and the second seal moves up and down in the gap to realize the switching of the two water outlet cavities. To keep the second control spigot from leaking, a seal is provided between the guide sleeve and the waterway body, and a seal is also provided between the second control spigot and the guide sleeve.

Further, the water outlet end is provided with a first water outlet nozzle 34 connected to the third cavity and a second water outlet nozzle 35 connected to the fourth cavity. The first water outlet nozzle can be a soft water nozzle, the second water outlet nozzle is a shower nozzle, the soft water nozzle is set on the inside of the water outlet end, the shower nozzle is set on the outside of the water outlet end, to bring a comfortable experience to the customer through the switch of the second button.

Figure 3:
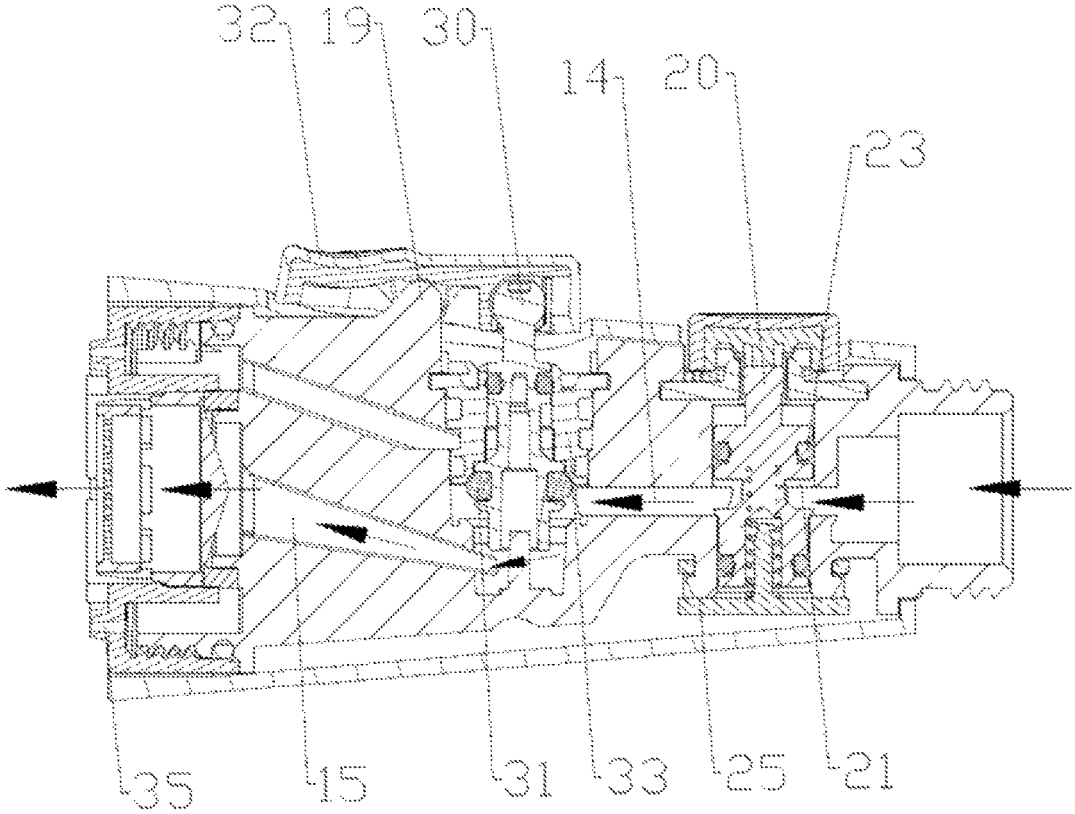
FIG. 3 is a cross-sectional view of state two of embodiment one of the present invention.
Figure 4:
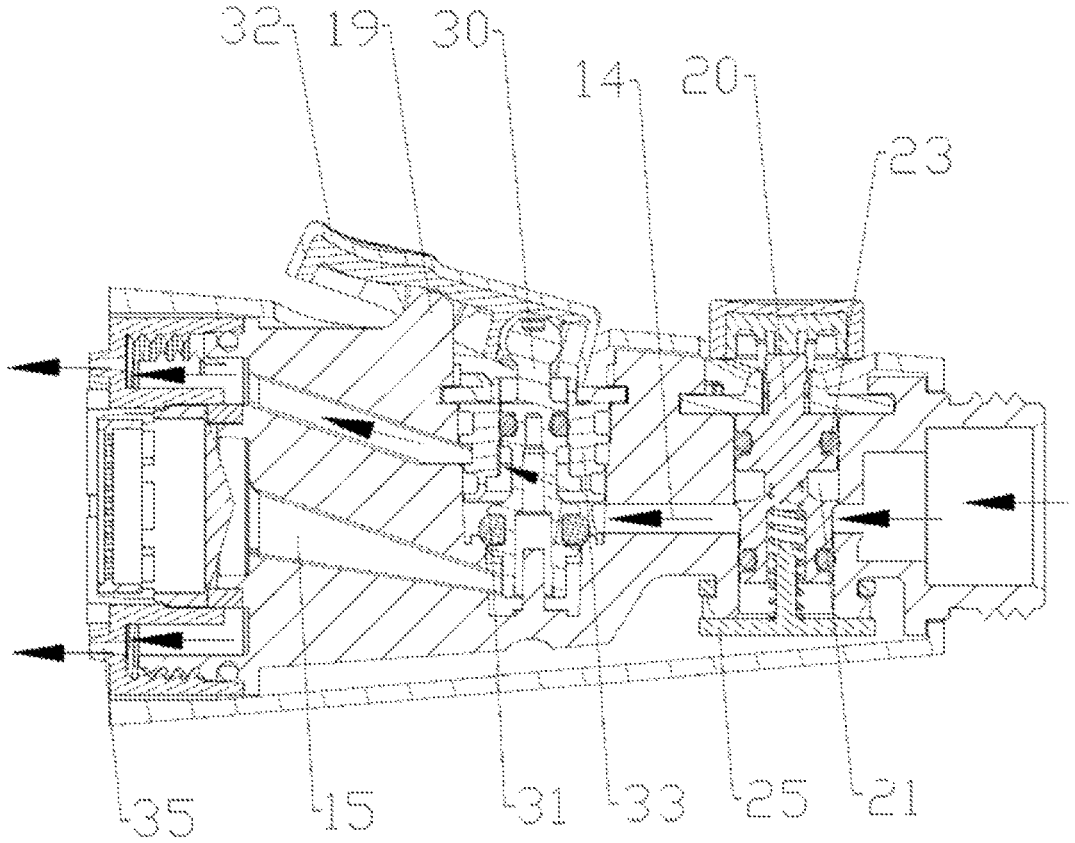
FIG. 4 is a cross-sectional view of state three of embodiment one of the present invention.
Figure 5:
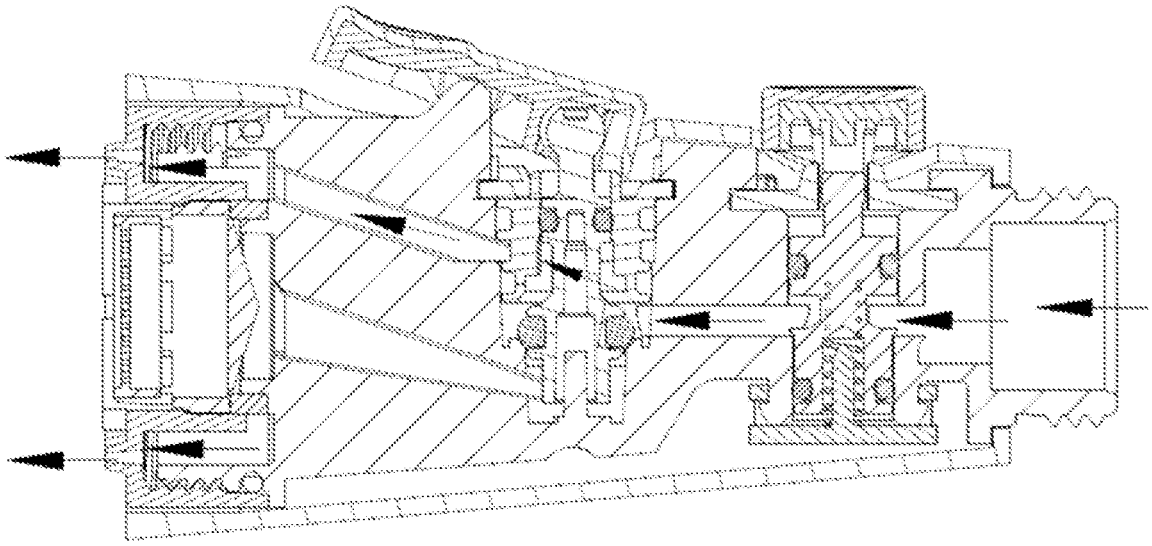
FIG. 5 is a cross-sectional view of state four of embodiment one of the present invention.
Figure 6:
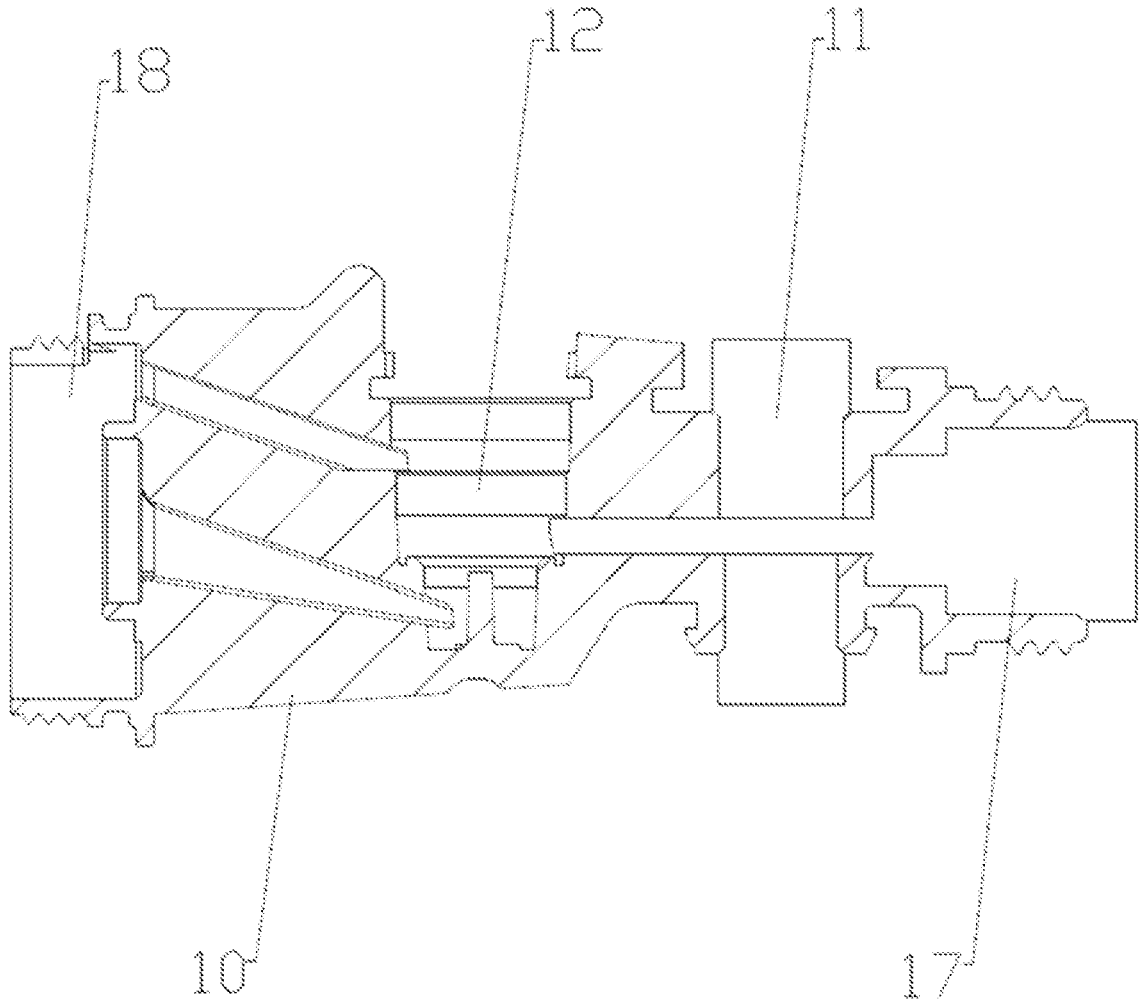
FIG. 6 is a cross-sectional view of the core extraction structure of the waterway body of embodiment one of the present invention.

In this embodiment, the first control spigot and the second control spigot are set on the same side of the waterway body. Referring to FIG. 1, when the first control spigot is in the top up position, it is in the throttling state, and the second control spigot is in the top up position, the water flows towards the third cavity and flows out from the first water outlet nozzle, forming the first form of water outlet in the throttling state; referring to FIG. 3, when the first control spigot is in the down position, it is in the open flow state, and the second control spigot is in the top up position, the water flows towards the third cavity, forming the first form of water outlet in the open flow state; referring to FIG. 4, when the first control spigot is in the up position and in the throttling state, the second control spigot is in the down position, the water flows towards the fourth cavity and flows out from the second outlet nozzle, forming the second outlet form in the throttling state, referring to FIG. 5, when the first control spigot is in the down position and in the open flow state, the second control spigot is in the down position, the water flows towards the fourth cavity and flows out from the second outlet nozzle, forming the second outlet form in the open flow state.

Specifically, the waterway body is manufactured using an integrated injection mold, and the valve cavity and cavity in the waterway body are completed by the core extraction structure of the mold, and the water inlet end of the waterway body is formed by the first core extraction structure 51 to form the first cavity and the second cavity connected with the water outlet end, and the first valve cavity is completed by the second core extraction structure 52 and the third core extraction structure 53 together, and the second core extraction structure and the third core extraction structure are located at the upper and lower ends of the corresponding positions of the mold.

In another embodiment, the first control spigot and the second control spigot can be provided on opposite sides of the waterway body. Since the first valve cavity is through, the head and tail directions of the first control spigot set in the first valve cavity are not fixed, so the first control spigot and the second control spigot can be set on the same side of the waterway body or on opposite sides of the waterway body, respectively. Such two designs make the installation of the first control spigot more diverse and meet the different needs of customers. When the two control spigots are on the same side, the buttons are also on the same side. When the first control spigot is installed on the opposite side of the second control spigot, the button is on the opposite side and the waterway of the second cavity is also formed at an angle. In this way, the water inlet end of the waterway body is completed by the first core extraction structure, the first valve cavity is completed by the second core extraction structure and the third core extraction structure located at the upper and lower ends of the mold, the fourth core extraction structure 54 is coupled to the inlet and outlet ends, the fourth core extraction structure is inclined, and the fourth core extraction structure collides with the first core extraction structure, the second core extraction structure and the third core extraction structure.

Figure 7:
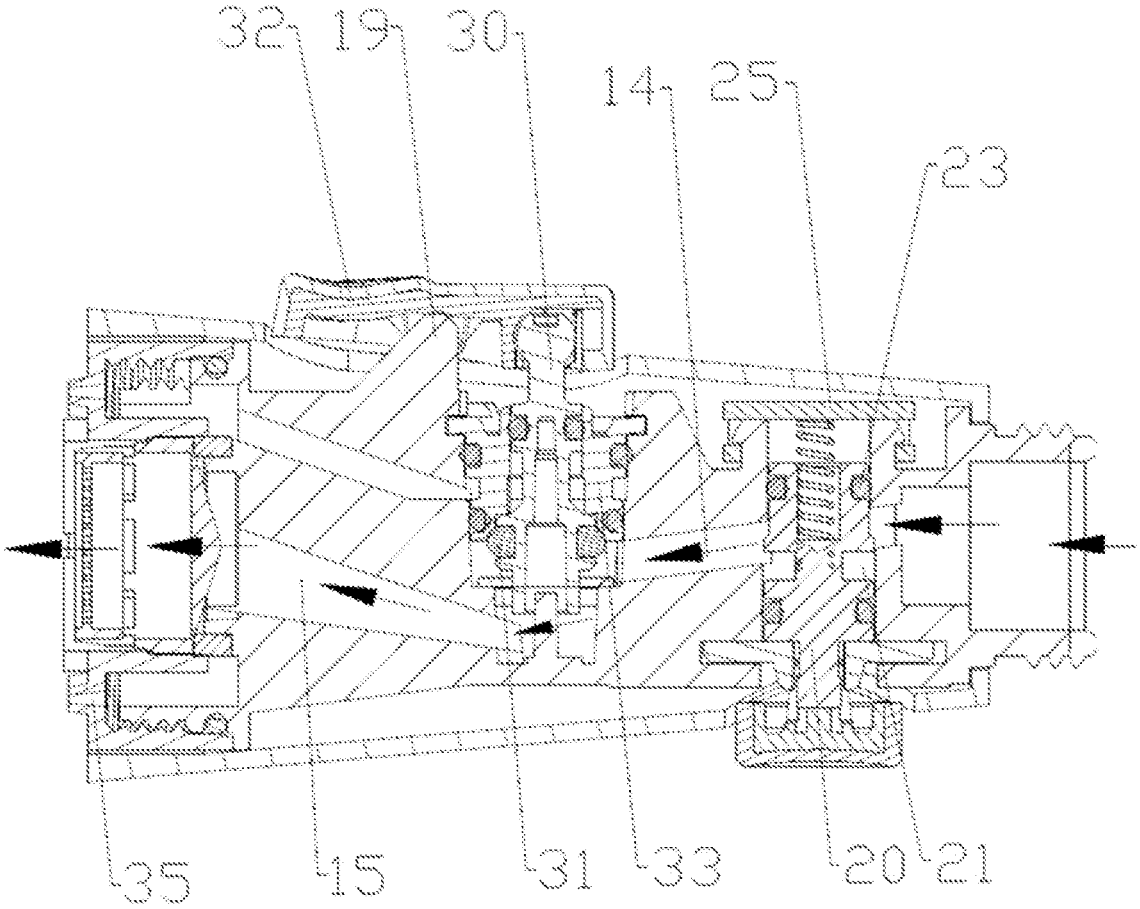
FIG. 7 is a cross-sectional view of state one of embodiment two of the present invention.
Figure 8:
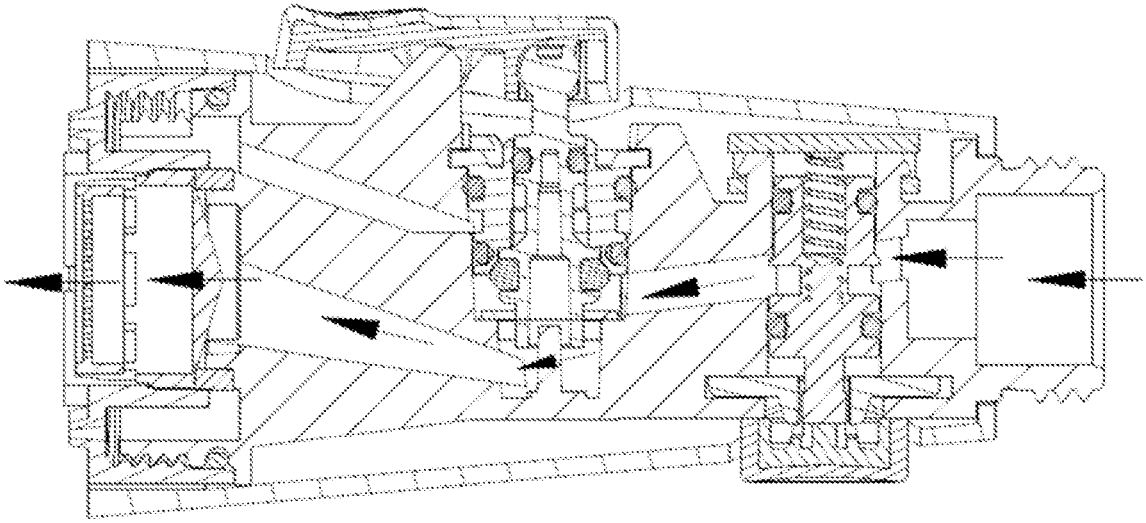
FIG. 8 is a cross-sectional view of state two of embodiment two of the present invention.
Figure 9:
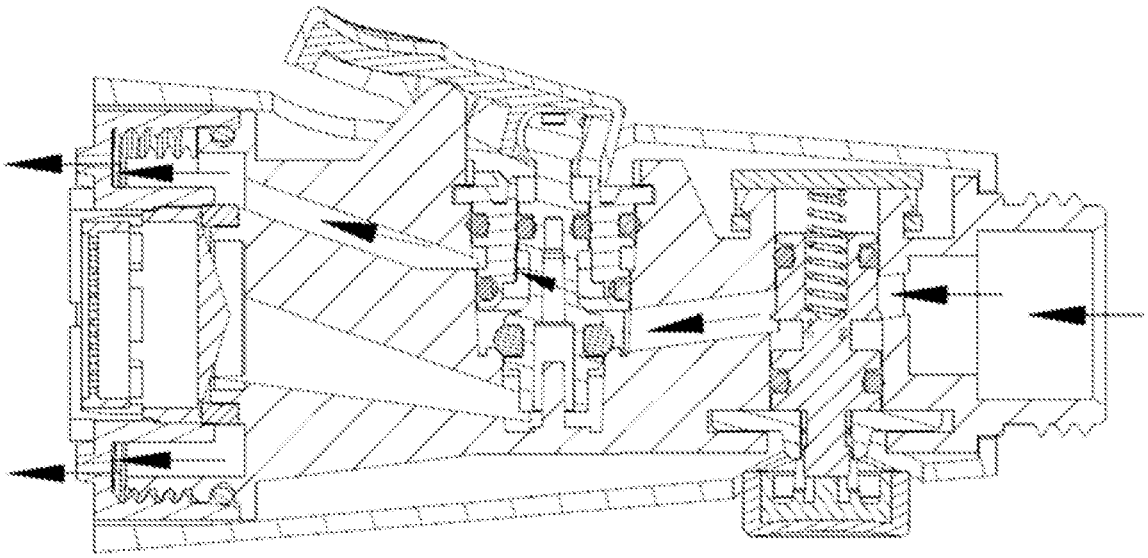
FIG. 9 is a cross-sectional view of state three of embodiment two of the present invention.
Figure 10:
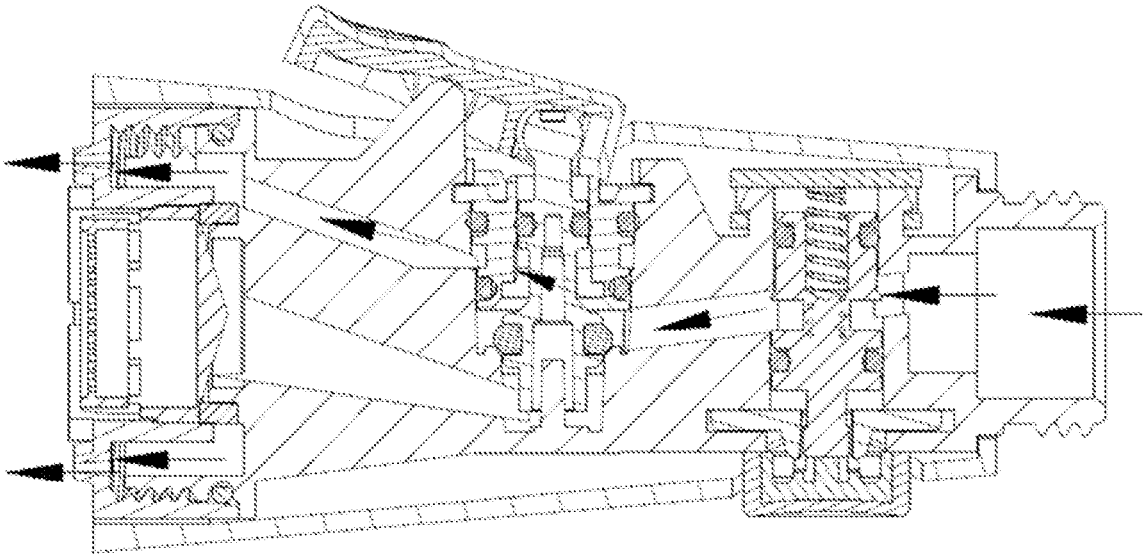
FIG. 10 is a cross-sectional view of state four of embodiment two of the present invention.
Figure 11:
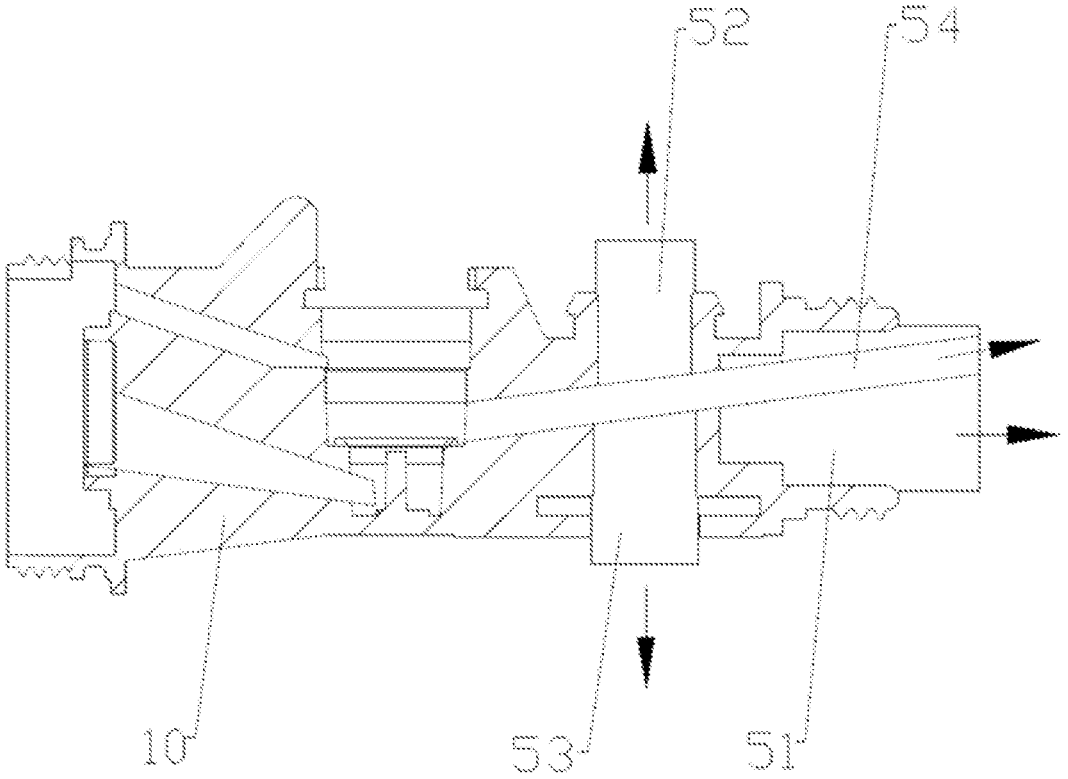
FIG. 11 is a cross-sectional view of the core extraction structure of the waterway body of embodiment two of the present invention.

Specifically, referring to FIG. 7, when the first control spigot is in the top-up position, in the throttling state, the second control spigot is in the top-up position, the water flows toward the third cavity and flows out from the first water outlet nozzle, forming the first form of water discharge in the throttling state; referring to FIG. 8, when the first control spigot is in the down position, in the open flow state, the second control spigot is in the top-up position, the water flows toward the third cavity; referring to FIG. 9, when the first control spigot is in the up position and in the throttling state, the second control spigot is in the down position, the water flows towards the fourth cavity and flows out from the second outlet nozzle, forming the second outlet form in the throttling state; referring to FIG. 10, when the first control spigot is in the down position and in the open flow state, the second control spigot is in the down position, the water flows towards the fourth cavity and flows out from the second outlet nozzle, forming the open flow form.

The above description shows and describes a preferred embodiment of the invention, and as previously stated, it should be understood that the invention is not limited to the form disclosed herein, and should not be regarded as an exclusion of other embodiments, but can be used in various other combinations, modifications and circumstances, and can be modified within the scope of the inventive concept described herein, by the above teachings or by skill or knowledge in the relevant field. And the modifications and variations made by those in the art which do not depart from the spirit and scope of the present invention shall all be within the scope of protection of the appended claims of the present invention.

The invention claimed is:

1. A pull-out head integrated waterway structure, characterized by an integrated waterway body, said waterway body provides a second valve cavity and a first valve cavity through the waterway body, said first valve cavity connects to the water inlet end of the waterway body through a first cavity, said first valve cavity and second valve cavity are connected through a second cavity, said second valve cavity connects to the water outlet end of the waterway body through the outlet cavity, the first valve cavity provides a first control spigot for controlling the size of water flow, the second valve cavity provides a second control spigot for switching water flow to a different outlet cavity.

2. A pull-out head integrated waterway structure according to claim 1, characterized in that the central outer ring of said first control spigot provides a notch part for large water flow, between the outer wall of the first control spigot and the inner wall of the waterway body provides a gap for small water flow, the upper and lower ends of the notch part respectively provides with a first seal.

3. A pull-out head integrated waterway structure according to claim 2, characterized in that said first valve cavity provides a first button matched with the first control spigot at one end, said first valve cavity provides a base matched with the first control spigot at the other end, said base matching of coupled with the waterway body, said first control spigot provides a first sink at the lower end, said base provides a convex pillar matched with the first sink, said first sink and the convex pillar are coupled with a resilient member.

4. A pull-out head integrated waterway structure according to claim 1, characterized in that said second valve cavity and the water outlet end are coupled with a third cavity and a fourth cavity, the outer ring of said second control spigot provides a second seal matched with the third cavity and the fourth cavity; said second seal blocks the fourth cavity as the second control spigot is moved up; said second seal blocks the third cavity as the second control spigot is moved down.

5. A pull-out head integrated waterway structure according to claim 4, characterized in that said second valve cavity provides a guide sleeve matched with the third cavity and the fourth cavity, said second control spigot is matched and arranged in the guide sleeve, the upper end of said second control spigot is coupled with a second button for controlling the second control spigot up and down, said second button also matching of coupled with the bump on the waterway body.

6. A pull-out head integrated waterway structure according to claim 4, characterized in that the water outlet end provides a first water outlet nozzle connected to the third cavity and a second water outlet nozzle connected to the fourth cavity.

7. A pull-out head integrated waterway structure according to claim 1, characterized in that said waterway body is manufactured and molded by an integrated injection mold, the valve cavity and the cavity in the body of said waterway body are completed by the core extraction structure of the mold, the water inlet end of said waterway body forms the first cavity and the second cavity connected to the water outlet end through a first core extraction structure, said first valve cavity is completed by a second core extraction structure and a third core extraction structure together, said second core extraction structure and said third core extraction structure are respectively located at the upper and lower ends of the corresponding position of the mold.

8. A pull-out head integrated waterway structure according to claim 1, characterized in that the water inlet end of said waterway body is completed by a first core extraction structure, said first valve cavity is completed by a second core extraction structure and a third core extraction structure located at the upper and lower ends of the mold, said fourth core extraction structure is linked to the water inlet end and the water outlet end, said fourth core extraction structure is inclined, said fourth core extraction structure collides with the first core extraction structure, the second core extraction structure and the third core extraction structure.

9. A pull-out head integrated waterway structure according to any one of claims 1-8, characterized in that said first control spigot and second control spigot are set on the same side of the waterway body.

10. A pull-out head integrated waterway structure according to any one of claims 1-8, characterized in that said first control spigot and second control spigot are set on opposite sides of the waterway body.

* * * * *